US005864076A

United States Patent [19]

Eder

[11] Patent Number: 5,864,076

[45] Date of Patent: Jan. 26, 1999

[54] CLARINET BARREL

[76] Inventor: Gunther Eder, August-von-Jaksch Strasse 21, A-9500 Villach, Austria

[21] Appl. No.: 765,397

[22] PCT Filed: Jul. 17, 1995

[86] PCT No.: PCT/AT95/00148

§ 371 Date: Jan. 8, 1997

§ 102(e) Date: Jan. 8, 1997

[87] PCT Pub. No.: WO96/04641

PCT Pub. Date: Feb. 15, 1996

[30] Foreign Application Priority Data

Aug. 1, 1994 [AU] Australia ..... GM 230/94

[51] Int. Cl.[6] ..... G10D 7/06

[52] U.S. Cl. ..... 84/382; 84/383 R; 84/386

[58] Field of Search ..... 84/382, 383 R, 84/380, 386

[56] References Cited

U.S. PATENT DOCUMENTS

| | | | |
|---|---|---|---|
| 1,308,903 | 7/1919 | Gulick | 84/386 |
| 2,098,457 | 11/1937 | Loomis | 84/386 |
| 2,508,550 | 5/1950 | Stubbins . | |
| 3,438,298 | 4/1969 | Thompson | 84/380 C |
| 5,249,499 | 10/1993 | Goldstein et al. | 84/386 |

FOREIGN PATENT DOCUMENTS

| | | |
|---|---|---|
| 2104377 | 4/1972 | France . |
| 37 02 055 | 8/1988 | Germany . |
| 2 030 752 | 4/1980 | United Kingdom . |

*Primary Examiner*—Michael L. Gellner
*Assistant Examiner*—Shih-yang Hsieh
*Attorney, Agent, or Firm*—Young & Thompson

[57] ABSTRACT

A clarinet barrel consists of two parts (2 and 3) screwed into each other. The inner part (2) carries a ring (8) with an outer thread (9) screwed into a ring-shaped part (14) of the outer part (3) provided with an inner thread (15). The inner part (2) has a cylindrical section (4) in which is arranged a sealing ring (21) that seals section (11) of the outer part (3). The bore M has the same size and no steps in the area of the inner bore of the sections (7), in the area of the ring (8) and in the area of a shoulder (16) adjacent to the ring-shaped part (15). The effective length of the clarinet barrel 91) may be changed and the clarinet may be tuned by rotating the parts (2 and 3) against each other.

7 Claims, 2 Drawing Sheets

CLARINET BARREL

FIELD OF THE INVENTION

The invention concerns a clarinet barrel.

BACKGROUND OF THE INVENTION

The method normally used to tune a clarinet is to alter the position of the barrel in relation to the top joint. To this end, the clarinet barrel is pulled upwards from the top joint by approx. 1–2 mm. Since the barrel is merely pushed onto the top joint (a corked tenon on the top joint of the clarinet grips into a socket on the clarinet barrel), i.e. the connection is simply of a push-pull type, it is not only difficult to adjust the exact relative position between the clarinet barrel and the top joint to tune the instrument, but there is also a risk that the position of the barrel in relation to the top joint will alter unintentionally.

A further disadvantage of the state of the art is that at the point of transition between the tenon on the top joint of the clarinet that grips into the clarinet barrel and the clarinet barrel itself there is a difference in the diameter of the bore (the internal diameter of the clarinet), creating a gap between the end of the top joint and the clarinet barrel. This causes problems by negatively effecting the intonation of the short notes A and B-flat.

From U.S. Pat. No. 5,249,499 A, a clarinet barrel is known whose effective length can be adjusted to tune the clarinet with 2 threaded parts screwing into each other. The clarinet barrel in U.S. Pat. No. 5,249,499 A consists of a fixed part mounted on the top joint and a threaded ligature that can be screwed into position with the help of the outer casing of the fixed part. In addition, the clarinet barrel to U.S. Pat. No. 5,249,499 A is fitted with a part to be connected to the mouthpiece of the clarinet and which, by means of an extension socket, is inserted into the extension socket of the fixed part. The part of the clarinet barrel to be connected to the mouthpiece of the clarinet carries an outer thread that is screwed onto the inner thread of the threaded part. By rotating the threaded part, the part of the clarinet barrel connected to the mouthpiece is moved towards the fixed part or away from it, depending on the direction of turn, thus shortening or lengthening the clarinet barrel.

SUMMARY OF THE INVENTION

The invention is based on the task of specifying a clarinet barrel that permits simple and reliable turning of the clarinet and which has a simple structure without an appearance that differs from the usual non-extensible clarinet barrel.

The clarinet barrel according to the invention permits the clarinet to be tuned simply without changing the position of the clarinet barrel with respect to the top joint of the clarinet. Since the use of the clarinet barrel according to the invention does not give rise to any great difference in the inner bore when tuning the clarinet, no problems arise with the short notes.

In the invention, the necessary change in the length of the clarinet barrel that alters the distance between the mouthpiece and the top joint, as needed to tune the clarinet, is particularly simple to achieve, permitting a spatially favorable arrangement and simple design of the clarinet barrel. Since in the clarinet barrel according to the invention the inner part of the clarinet barrel is connected to the outer part of the barrel by a threaded connection, the length of the clarinet barrel can be adjusted by simply turning the outer part in relation to the inner part. In the invention there is also no risk that the setting of the length of the clarinet barrel will change.

The two parts of the clarinet barrel that fit together are preferably sealed by the provision of a ring-shaped groove in the outer surface of the inner part of the clarinet barrel. This groove contains a sealing ring that presses against the inner surface of the outer part of the clarinet barrel.

In one embodiment of the invention, it is provided that a ring is fixed to the inner part of the clarinet barrel, forming an extension bearing an outer thread, with a ring-shaped part bearing an inner thread fitted to the outer part of the clarinet barrel. This embodiment involves a simplification in production since the threaded part does not need to be directly cut out of the outer or inner part of the clarinet component.

One embodiment has proved successful in which it is provided that the parts carrying the thread are made of synthetic material while the inner part and outer part of the clarinet barrel are made of wood. This embodiment has the advantage that an appropriately fine thread can be applied that permits an exact adjustment of the length of the clarinet barrel without the disadvantages that wood has for threaded parts, while still retaining the advantages of wood for the clarinet barrel.

Within the invention one embodiment is preferred in which it is provided that the ring with the outer thread protrudes from the inner part of the clarinet barrel over its end,i and that the ring-shaped part with the inner thread is fitted with a circular shoulder on the outer part of the clarinet barrel. In this embodiment it can also be provided that the circular shoulder located on the inside of the outer part protrudes radially inwards over the circular part with the inner thread. This creates a practically step-free transition between the inner part and the outer part of the clarinet barrel, particularly at the inner and outer thread.

It is of advantage in the invention if the inner diameter of the bore of the inner part and of the outer part of the clarinet barrel is the same size as that of the ring with the outer thread and the circular shoulder, and corresponds to the bore of the clarinet.

One embodiment of the invention provides that the inner part of the clarinet barrel is fitted with a metal ring on the outside at the end to be connected with the mouthpiece. In addition, it can be specified that the end of the outer part of the clarinet barrel to be connected with the top joint of the clarinet is fitted with a metal ring. These metal rings which can, for instance, be knurled, make it easier to adjust the two parts of the clarinet barrel when setting the length of the clarinet barrel to the desired length.

Finally, within the invention it is of advantage that the sections at each end of the clarinet barrel taking the tenons of the mouthpiece and the top joint of the clarinet are of a wider bore than that of the clarinet.

BRIEF DESCRIPTION OF THE DRAWINGS

Further details of the invention are set out in the following description of a clarinet barrel according to the invention, to which reference is made in the attached drawing.

DETAILED DESCRIPTION OF THE INVENTION

A clarinet barrel 1 consists of an inner part 2 and an outer part 3. Both the inner part 2 and the outer part 3 are preferably made of wood as is usual in clarinet-making.

Figure 1:
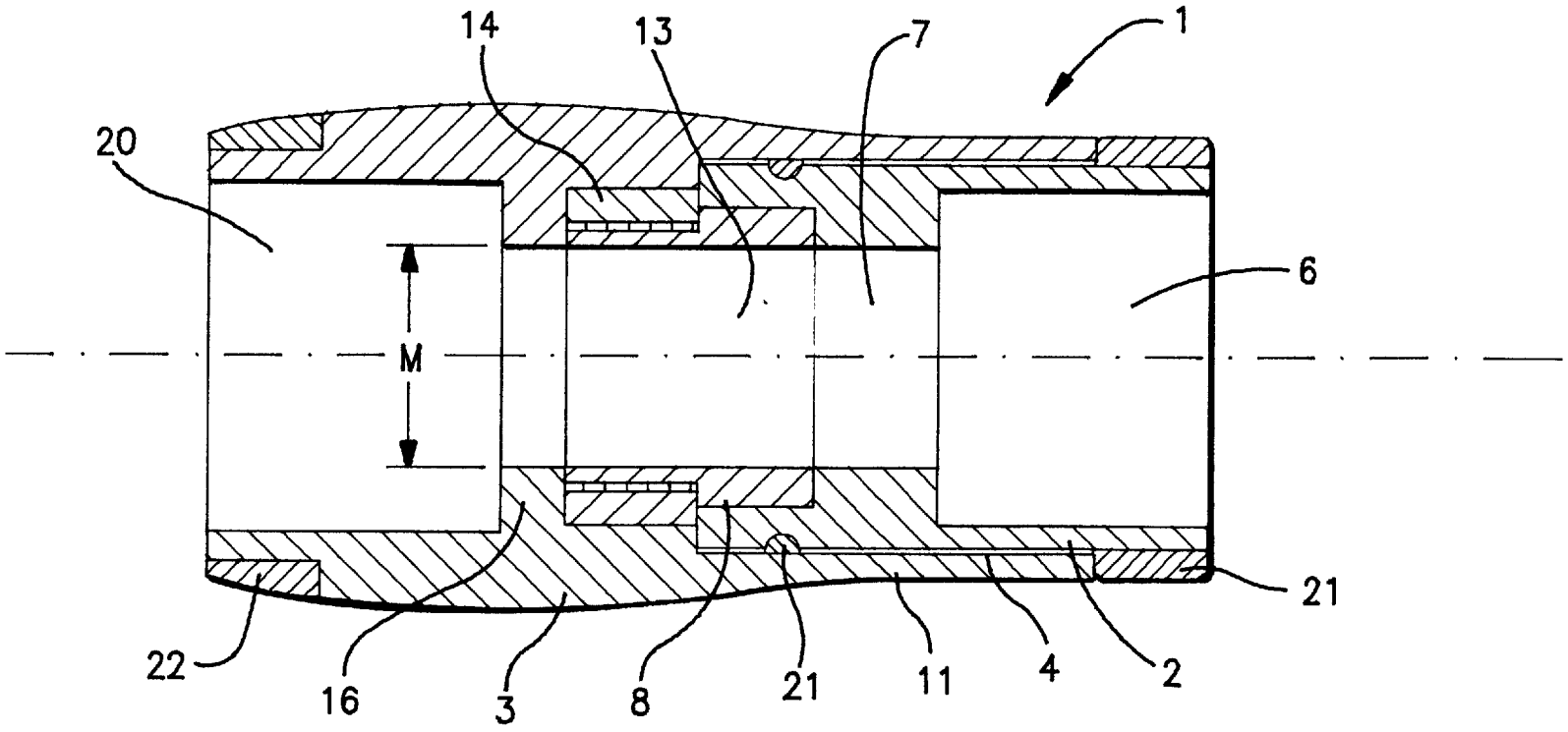
FIG. 1 shows a cross section of a clarinet barrel.
Figure 2:
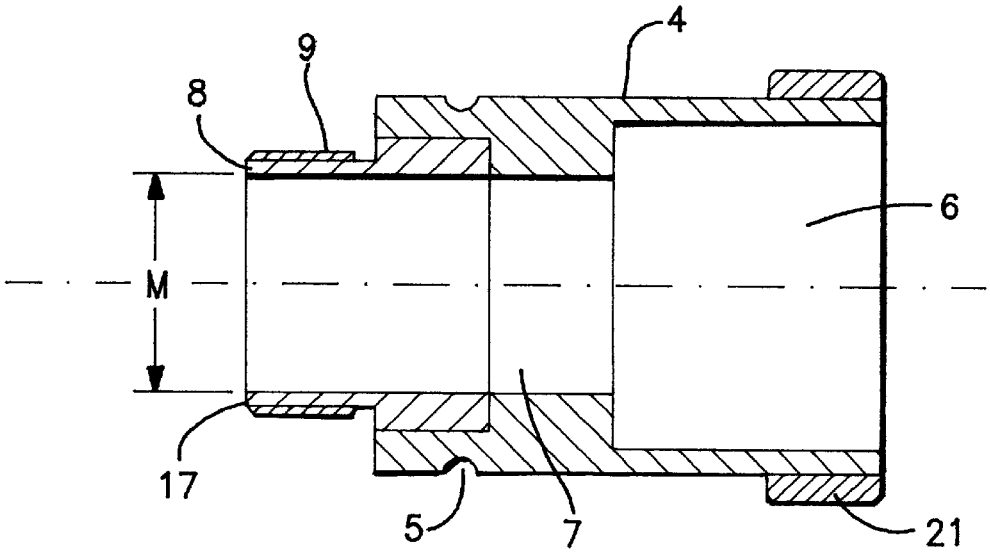
FIG. 2 the inner part.

The inner part 2 is a component of rotational symmetry of essentially cylindrically external shape. A groove is cut into the cylindrically outer surface 4 of inner part 2, in which a ring as seal 21 (not shown in FIG. 2) can be inserted.

The inner bore of inner part 2 has a section 6 with a wider diameter in which a tenon on the clarinet mouthpiece is inserted. The diameter of the following section 7 of the bore in the inner part 2 corresponds with the bore of the clarinet, diameter M.

At the end of the inner part 2 opposite section 6 a ring 8 made of plastic is inserted with an outer thread 9 on its outer surface. The inner diameter of ring 8 is selected such that it corresponds with the bore (diameter M) of section 7 of inner part 2.

Figure 3:
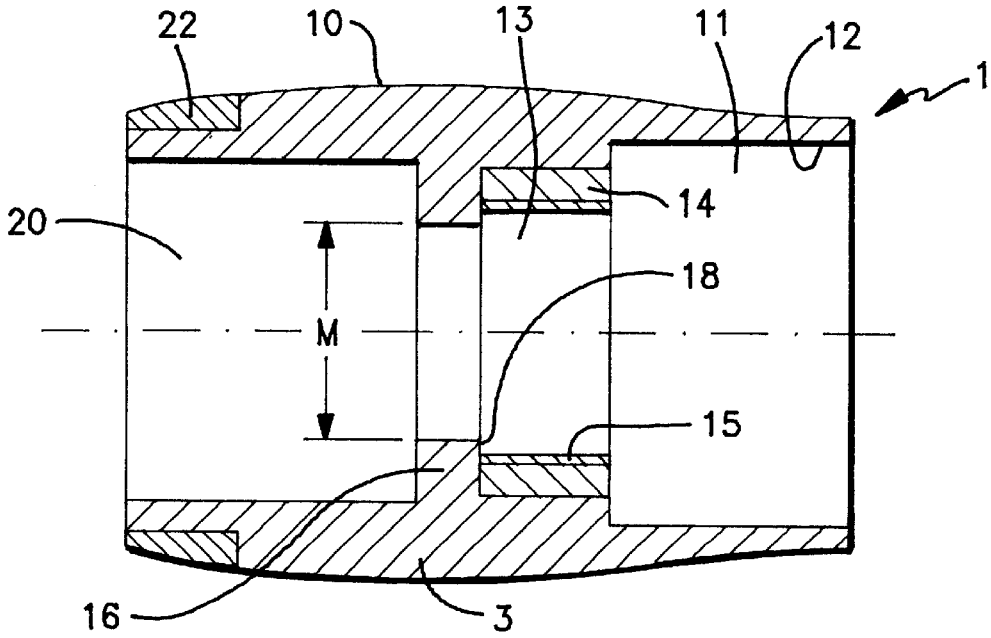
FIG. 3 the outer part, both in cross section.

The outer part 3 shown in FIG. 3 is also a component with rotational symmetry with, for instance, a bulged or flared outer surface 10, and which is likewise preferably made of wood.

In outer part 3, a several-staged bore is provided, section 11 of which is designed to take the section (with outer wall 4) of inner part 2 fitted with the circular groove 5 and the sealing ring 21 inserted therein. Section 11 of the inner bore of the inner surface 12 of outer part 3 is cylindrical in shape.

In section 13 of outer part 3, a circular part 14 with inner thread 15 is inserted, into which can be screwed the ring 8 of inner part 2 with the outer thread. The outer thread 9 and the inner thread 15 are thus threads that fit together.

Adjacent to section 13, on outer part 3, a circular shoulder 16, the inner diameter of which M corresponds with the bore of the clarinet, protrudes beyond the circular part 14. When the clarinet barrel 1 is fully screwed together, the front edge 17 of the casing 8 presses against the end surface of circular shoulder 16 that is facing it.

The outer part 3 of the clarinet barrel according to the invention 1 is fitted with a section 20 with a widened diameter to take a tenon on the top joint of the clarinet.

Both inner part 2 and outer part 3 can be fitted with metal rings 21 and 22 respectively, which not only improves stability at the end areas of the clarinet barrel 1 but also, if rings 21 and 22 are formed in a manner increasing friction (for instance knurled or corrugated), facilitates the adjustment of the length of clarinet barrel 1 when parts 1 and 2 are rotated against each other.

In summary, an embodiment of the invention can be described as follows:

A clarinet barrel consists of two parts 2 and 3 screwed into each other, whereby the inner part 2 carries a ring 8 with an outer thread 9 screwed into a ring-shaped part 14 of outer part 3 provided with an inner thread 15. The inner part 2 has a cylindrical section 4 in which is arranged a sealing ring 21 that seals section 11 of outer part 3. The bore M has the same size and no steps in the area of the inner bore of section 7, in the area of the ring 8 and in the area of the shoulder 16 adjacent to the ring-shaped part 14. The effective length of the clarinet barrel 1 may be changed and the clarinet may be tuned by rotating the parts 2 and 3 against each other.

I claim:

1. Clarinet barrel (1), which is arranged between a mouthpiece and an upper part of a clarinet, wherein the clarinet barrel (1) consists of two parts (2, 3) that are sealed with respect to one another, wherein an inner part (2) of the clarinet barrel (1) has external threading (9), wherein in an outer part (3) of the clarinet barrel (1) is attached a ring-shaped part (14) which has internal threading (15), and wherein said inner part (2) is screwed with said external threading (9) into said internal threading (15) on said ring-shaped part (14), so that a working length of the clarinet barrel (1) can be adjusted by turning inter-threaded parts (2, 3) of the clarinet barrel (1), wherein between a cylindrical outer surface (4) of said inner part (2) and a cylindrical inner surface (12) of said outer part (3) of clarinet barrel (1) is a circumferential joint (21), wherein said inner part (2) of said clarinet barrel (1) has a bushing-like projection which does not touch said inner part (2) and at which said external threading (9) of said inner part (2) is provided, wherein said ring-shaped part (14), which is secured in said outer part (3) of said clarinet barrel (1) and has said internal threading (15), is provided in the area of a ring-shaped shoulder (16), which is arranged on an inside of said outer part (3), and wherein said ring-shaped shoulder (16) projects radially inwardly over said ring-shaped part (14) that has said internal threading (15), wherein the inside diameter of a bore of said inner part (2) and that of said outer part (3) of said clarinet barrel (1), as well as an inside diameter of said ring (8) which has said external threading (9) and that of said ring-shaped shoulder (16) are of equal size and correspond to scale (M) of the clarinet.

2. A clarinet barrel according to claim 1, wherein in said outer surface (4) of said inner part (2) of said clarinet barrel (1) is arranged a ring-shaped groove (5), in which a circumferential joint (21) is arranged which is adjacent to said inner surface (12) of said outer part (3) of said clarinet barrel (1).

3. A clarinet barrel according to claim 1, wherein to said inner part (2) of said clarinet barrel (1) a ring (8) is attached which has a bushing-like projection on which said external threading (9) of said inner part (2) is located.

4. A clarinet barrel according to claim 1, wherein said parts (8, 14) that have said threading (9, 15) are made of plastic, whereas said inner part (2) and said outer part (3) of said clarinet barrel (1) are made of wood.

5. A clarinet barrel according to claim 1, wherein at an end that is to be connected to a mouthpiece and/or at an end of said outer part (3) that is to be connected to an upper part of the clarinet, said inner part (2) of said clarinet barrel (1) has a metal ring (21, 22A) on an outside of said inner part (2).

6. A clarinet barrel according to claim 5, wherein said metal rings (21, 22) are knurled on an outside of said metal rings.

7. A clarinet barrel according to claim 1, wherein at both ends of said clarinet barrel (1) opposite said scale (M) there are enlarged-diameter sections (6, 20) to accommodate projections of a mouthpiece and an upper part of the clarinet.

* * * * *